United States Patent [19]

Bock

[11] 4,197,696

[45] Apr. 15, 1980

[54] METHOD AND APPARATUS FOR PRODUCING A WRAP-AROUND YARN

[75] Inventor: Erich Bock, Ingolstadt, Fed. Rep. of Germany

[73] Assignee: Schubert & Salzer, Ingolstadt, Fed. Rep. of Germany

[21] Appl. No.: 917,111

[22] Filed: Jun. 19, 1978

[30] Foreign Application Priority Data

Jun. 28, 1977 [DE] Fed. Rep. of Germany ..... 2729060

[51] Int. Cl.[2] ..... D02G 3/36; D01H 7/88

[52] U.S. Cl. ..... 57/18; 57/58.3

[58] Field of Search ..... 57/16–18, 57/106, 144, 160, 58.3, 3, 6

[56] References Cited

U.S. PATENT DOCUMENTS

| | | | |
|---|---|---|---|
| 2,343,535 | 3/1944 | Clarkson | 57/58.3 |
| 2,400,697 | 5/1946 | Lewis | 57/58.3 |
| 2,442,775 | 6/1948 | Nelson | 57/58.3 |
| 2,737,773 | 3/1956 | Clarkson | 57/58.3 X |
| 2,913,867 | 11/1959 | Schrenk | 57/58.3 |
| 2,939,267 | 6/1960 | Klein | 57/58.3 |
| 3,328,946 | 7/1967 | Schumann et al. | 57/18 |
| 3,681,909 | 8/1972 | Korikovsky et al. | 57/106 |
| 3,831,369 | 8/1974 | Northrup et al. | 57/160 X |
| 3,899,867 | 8/1975 | Northrup et al. | 57/18 |
| 4,028,874 | 6/1977 | Maag et al. | 57/160 X |
| 4,080,779 | 3/1978 | Freeman et al. | 57/18 X |

FOREIGN PATENT DOCUMENTS 283865 12/1970 U.S.S.R. .

*Primary Examiner*—John Petrakes

*Attorney, Agent, or Firm*—Bailey, Dority & Flint

[57] ABSTRACT

The invention relates to apparatus and method for producing a wrap-around yarn of the type having an untwisted core thread with a binder thread helically wrapped around the core thread wherein the core thread is given a false twist and the core thread and binder thread are passed through separate openings through a hollow spindle to a core thread deflection point at which time the false twist is removed from the core thread and at which point the binder thread is wrapped helically around the core thread.

11 Claims, 4 Drawing Figures

METHOD AND APPARATUS FOR PRODUCING A WRAP-AROUND YARN

BACKGROUND OF THE INVENTION

Various suggestions have already been made for producing a wrap-around yarn comprised of a substantially untwisted core yarn, or roving, around which a binder thread is helically wound. Thus, for example, U.S. Pat. No. 3,328,946 illustrates an untwisted core yarn supplied by the rollers of a drafting system being fed through a stationary tube on which is rotatably mounted a bobbin containing the binder or wrap-around thread, the spindle being belt driven. The binding thread coming from the rotating bobbin and, likewise, being introduced into the stationary tube is thus deposited, in the area of the inlet opening of the tube, helically around the untwisted core thread thus strengthening the thread. In order to keep to a minimum the possible breakage of the core yarn, the inlet opening of the tube is arranged at a distance from the supply rollers which corresponds to the average length of the staple fibers in the core thread and an air stream directed against the take-up rollers is introduced into the stationary tube.

This principle is also used in another known method in which the bobbin with the binder thread is arranged on a driven hollow spindle and rotates with the same (U.S. Pat. No. 3,831,369). This has the disadvantage that because of the necessary close positioning of the guide tube or the hollow spindle with respect to the supply rollers, operation of the device is made more difficult and the adjustment of the distance between these parts of the device and the length of fiber to be processed must be matched. Furthermore, the production of turbulent air and the drive of the bobbin for supporting the binder threads and its associated balance problems require additional technical layout and increased operating costs which reduce the economic viability of this yarn production method. A reduction in the economic viability is also brought about by the fact that the imbalances caused by the rotation of the bobbin reduce the package weight of the bobbin.

It has also been proposed to feed the untwisted core thread coming from a pair of rollers through the hollow axle of a false twist spindle and to give it a temporary or false twist by means of a friction ring arranged at the inlet opening of the spindle (DT-PS No. 1,685,881). The binder thread, which is taken off a bobbin arranged coaxially to the false twist spindle and driven by the same, is likewise fed to the inlet opening of the spindle and is helically wound around the untwisted core thread. During the passage through the hollow spindle, the yarn is subjected to a drawing process at the hand of the take-up rollers, which are in the form of drawing rollers, and are finally fed to a take-up bobbin. By means of the false twist which the core thread has been given and which, as a result of the wrap-around process is again undone, the core thread is given sufficient strength prior to wrapping around with the binder thread. The above said disadvantages which result from a driven bobbin, however, are also present in this known solution.

In U.S. Pat. No. 4,028,874, a method for producing a roving is disclosed wherein a filament binder yarn is wound onto a stationary bobbin of small diameter and thereafterwards the binder yarn from the bobbin, together with the fiber band is passed through the hollow bobbin axis, whereby the fiber band is wrapped around by the filament binder. In this case, the number of the windings taken from the bobbin corresponds to the number of the windings applied to the fiber core bands. This means that even in the case of small bobbin diameters and, thus, small package weight, the number of windings which can be placed around the fiber core is limited. Thus, this method is suitable only for the production of a roving which will then have to be subjected to drawing and therefore may only have a strength which will not impair this process.

Accordingly, an important object of the present invention is to provide a method and device which avoids the above disadvantages and in a simple and cost saving manner enables the production of a wrap-around yarn with high output of production and the choice of any number of windings per unit length.

SUMMARY OF THE INVENTION

According to the method of the invention, the core thread and the binder thread are passed separately through respective openings into a hollow spindle. The binder thread is passed through a section of the hollow spindle to a core thread deflection point at which the false twist is removed from the core thread and in the area of this deflection point, the binder thread is wrapped helically around the core thread.

Advantageously, the core thread and the binder thread are passed through the hollow spindle in opposite directions toward the spindle center, are deflected and discharged from the hollow spindle through an opening in the wall of the hollow spindle whereupon the core thread and the binder thread are deflected for a second time and the binder thread wrapped around the core thread. In a variation of the method, after a first deflection, the core thread is passed through an opening in the wall of the hollow spindle and is introduced into the same, thus deflected a second time and passed through the hollow spindle, while the binder thread passes straight through the hollow spindle and is wound around the core thread in the area of the second deflection point.

Apparatus for carrying out the method comprises a rotatable hollow spindle which carries a spindle disk rigidly fixed thereto. In the vicinity of the spindle disk, in the outer wall of the hollow spindle is an opening. A bobbin is non-rotatably carried on the hollow spindle having the binder thread formed thereon. A constructionally simple solution for stopping the bobbin consists in rotatably mounting the bobbin on the hollow spindle in a space between the spindle disk and one end thereof, and preventing it from rotating by a magnetic field. Because the spindle disk has a retention device for the binder thread and/or the core yarn, the same is prevented from possible displacement.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
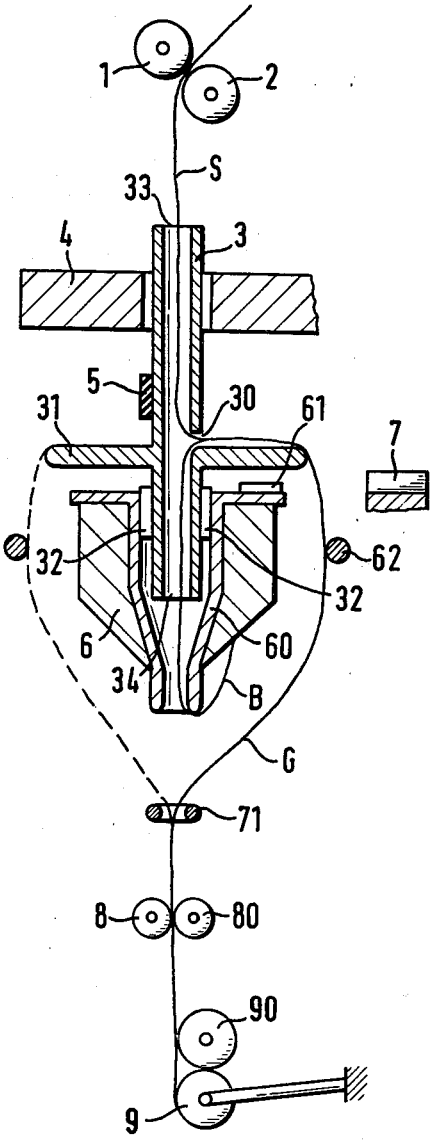
FIG. 1 is a side elevation illustrating a wrap-around device according to the invention partly in section, FIG . 2 is an illustration of the device of FIG. 1 turned through 180 degrees, FIG . 3 is a longitudinal cross-section of an embodiment of a spindle disk adapted to be in the form of balloon limiting rings according to the invention.

A drafting system is provided by a pair of rollers 1, 2 supplying a core thread S after which there is provided a hollow spindle 3 in such a manner that the nip of the rollers and the longitudinal axis of the hollow spindle are arranged essentially in the same vertical plane (FIG. 1). The hollow spindle 3 is rotatably mounted in a frame 4 and is continuously driven, for example by means of a tangential belt 5. The wall of the hollow spindle 3 has an opening 30 near which is arranged a spindle disc 31 on the hollow spindle 3. The hollow spindle 3 and the spindle disk 31 are made from one piece, or integrally connected with each other. Below the spindle disk 31 on a bearing 32 of the hollow spindle 3 is rotatably and removably arranged the bobbin spool 60 of a bobbin 6. The bobbin 6 contains a binder thread B which may be a filament, a yarn or even a twist yarn.

The bobbin spool 60 carrying the binder thread B is arranged in the space between the spindle disk 31 and the free end of the hollow spindle 3 facing a pair of take-off or draw-off rollers 8, 80 at such a distance from the spindle disk 31 that the free end of the bobbin spool 60 extends beyond the end of the hollow spindle 3. If necessary the free end of the bobbin spool 60 may be almost flush with the end of the hollow spindle 3. The rotation of the bobbin 6 in its bearing 32 coaxially to the hollow spindle 3 is magnetically arrested by a magnetic field. For this purpose a magnet 7 is permanently fixed to the machine chassis at a distance from the bobbin 6 and acts upon an iron part 61 fixed to the bobbin spool 60. The bobbin is surrounded by a ballon limiting ring 62.

The hollow spindle 3 and its bobbin 6 mounted thereon is followed by a yarn guide 71, the yarn take-up rollers 8, 80, already mentioned, and a wind-up device with a bobbin 9 for taking up the finished wrap-around yarn G, and a roller 90 for driving the bobbin 9. The yarn guide 71 and the nip of the take-up roller 8, 80 are arranged in an essentially vertical plane as defined by the longitudinal axis of the hollow spindle 3.

There now follows a description of the device according to FIG. 1 for producing a wrap-around yarn, whereby the passage of the thread is explained first:

The core thread S coming from the supply rollers 1, 2, the thickness of which is dependent upon the yarn count to be produced, is fed into the opening 33 of the hollow spindle 3 facing the supply roller and passes towards the spindle center through the section of the hollow spindle 3 which extends from the opening 33 to the opening 30 in the wall of the hollow spindle 3. At the opening 30 the core thread S is deflected and again emerges sideways from the hollow spindle 3. The binder thread B is taken off the stationary bobbin 6 and via the free end of the bobbin spool 60 is fed through the opening 34 facing the pair of rollers 8, 80, into the hollow spindle 3. It then likewise travels in the direction towards the center of the hollow spindle 3 through the section between opening 34 and opening 30 and emerges from the hollow spindle 3 after being deflected at opening 30. The two yarn components separately pass through the hollow spindle 3 in opposite directions and after their exit from the hollow spindle 3, are deflected for a second time by means of the spindle disk 31 and fed inside the balloon limiting ring 62. The finished wrap-around yarn G then travels downwards through the yarn guide 71 to the take-up rollers 8, 80 and further to the wind-up device.

It should be pointed out at this point, that instead of opening 30 in the wall of the hollow spindle, it is also possible to provide two openings so that the core thread S and the binder thread B each have their own opening for the exit from the hollow spindle 3.

During operation the hollow spindle 3 is continuously driven by the tangential belt 5, while the bobbin 6 mounted on the spindle is held in a stationary position by magnet 7. As a result of the rotation of the hollow spindle 3 with the spindle disk 31 the core thread S receives a twist which extends from the outer rim of the spindle disk 31, where the core thread S receives its second deflection, to the nip point of the supply rollers 1, 2. The staple fibers of the core thread S are therefore strengthened to such an extent that the danger of breakage on the section between the supply rollers 1, 2 and the spindle disk 31 is substantially eliminated. The twist which the core thread S has received, however, is a false twist or temporary twist, which will be undone again when the core thread S has passed the second deflection point at the spindle disk 31. As the twist goes back to zero, or substantially zero, in the area of this deflection point the tensioned binder thread B winds itself helically round the core thread S. The number of wrap-around windings per unit of length exclusively determines the ratio between the supply rate of the supply rollers 1, 2 and the speed of rotation of the hollow spindle 3 and the spindle disk 31, which is therefore optional. Likewise the tension of the binder thread B is matched to the particular requirements, in that the free end of the bobbin spool 60, over which the binder thread B is passed, is arranged in such a way that it subjects the thread to a more or less intense etainer force. If necessary for proper tension it is possible to fit to the free end of the bobbin spool 60 a crown with appropriate retainer properties (see FIGS. 3 and 4).

The wrap-around yarn G thus produced, comprising the untwisted core thread S and the wrapped-around binder thread B giving it its desired strength, is taken off by the take-up rollers 8, 80 through the yarn guide and wound onto bobbin 9.

Figure 2:
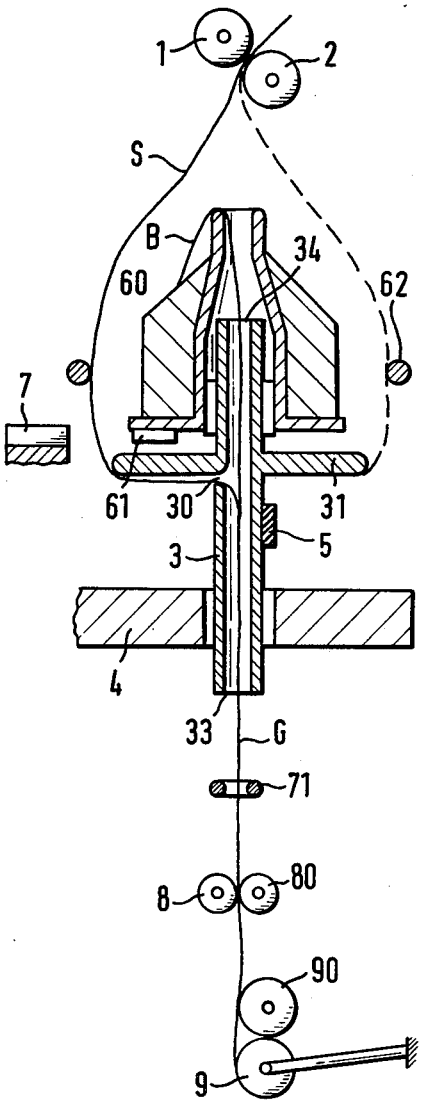

FIG. 2 shows the device according to FIG. 1 turned through 180 degrees, thereby providing an alternative thread passage for the production of the wrap-around yarn G.

The core thread S after leaving the supply rollers 1, 2, while forming a yarn balloon, travels downwards between the balloon limiter 62 and the bobbin 6 held in the stationary position by magnet 7 and is deflected at the edge of disk 31 so that it now enters the spindle substantially radially through the opening 30 in the wall of the hollow spindle 3. After passing through the opening 30 the core thread S is deflected for a second time in order to enter the opening 33 of the hollow spindle 3 now facing the take-off rollers 8, 80.

The binder thread B taken from the bobbin 6, as in FIG. 1, is introduced, around the free end of the bobbin spool 60, into the opening 34 of the hollow spindle 3 and passes through the spindle section between the openings 34 and 30 separately of the core thread S. The binder thread B is then, however, still passed in a straight passage through the hollow spindle 3 so as to meet with the core thread S at its second deflection point at the opening 30 which together form the wrap-around yarn G and pass through the spindle section between the opening 30 and 33.

When the hollow spindle 3 and the spindle disk 31 are continuously driven by the tangential belt 5, the core thread S is provided with a false twist which starts at the second deflection point of the core thread S at the opening 30 and extends to the nip point of the supply rollers 1, 2. After the core thread S has passed the deflection point at the opening 30, the false twist is undone again and the binder thread B, in the area of this deflection point, comes together with the core thread S and winds itself around the same in a helical manner. The finished wrap-around yarn G is taken off the take-off rollers 8, 80 through the yarn guide 71 and wound onto the bobbin 9 driven by the roller 90.

As a result of the rotation of the hollow spindle 3 with the spindle disk 31 the wrap-around yarn G depicted in FIG. 1 and the false twisted core thread depicted in FIG. 2 form a yarn balloon which is subjected to air resistance. It is thus desirable to fix on the spindle disk 31 a retaining means for fixing the position of the yarn components. Advantageously, the outer rim of the spindle disk 31 is thus provided with a groove in which are arranged and retained the core thread and the binder yarn in the yarn passage according to FIG. 1, and only the core thread in the case of the yarn passage according to FIG. 2. Instead of a groove the spindle disk 31 may have a drilled hole near the outer rim through which the binder thread B and/or the core thread S is passed.

In a further embodiment of the invention according to FIGS. 1 and 2 the spindle disk 31 may be provided in the form of a ballon limiting ring.

Figure 3:
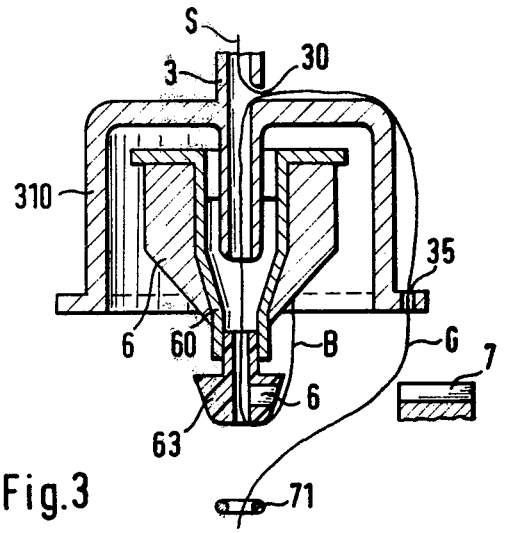

FIG. 3 shows such an embodiment in the form of a bell 310, which surrounds the bobbin 6 mounted on the hollow spindle 3. The core thread S and the binder thread B, as in FIG. 1, after their exit from the hollow spindle opening 30 are deflected at a second point on the outer wall 310*a* of the bell 310 and after the wrap-around process in the area of this deflection point travel as wrap-around yarn G through an opening 35 in the outer wall of the bell to the yarn guide 71. This limits the expansion of the yarn balloon.

Mounted on bobbin 6 or bobbin spool 60 is a crown 63 around which is passed the binder thread B during its travel around the hollow spindle 3. Shape or surface features of the crown 63 are largely determined by the desired retainer forces to which the binder thread B is subjected, and thus the tension with which the binder thread B is wound around the core thread S. The crown 63 which is made from an antimagnetic material, for example, a synthetic material, has a part 64 which is made from ferro magnetic material to which the stationary magnet 7 responds. The magnetic field thus produced prevents the bobbin 6 rotatably mounted on the hollow spindle 3 from rotating during rotation of the hollow spindle 3 so that the binder thread B can be taken off the stationary bobbin.

Figure 4:
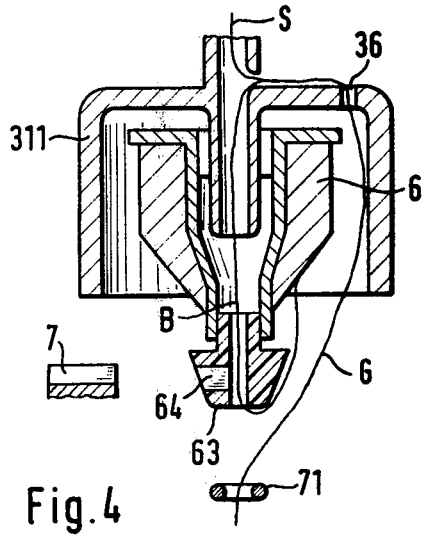
FIG. 4 is a longitudinal cross-section of an alternate embodiment of a spindle disk adapted to be in the form of balloon limiting rings according to the invention.

In the embodiment according to FIG. 4 the wrap-around yarn G forms the yarn balloon within a bell 311 surrounding the bobbin 6 in which the core thread S and the binder thread B are passed through an opening 36 in the base of bell 311. Second deflection of the core thread S and the binder thread B takes place during the entry into the opening 36 so that the false twist extends from this deflection point to the supply rollers, and becomes undone again after passing the deflection point. The remaining parts of the device are identical with those of FIG. 3.

The spindle disks in the form of a bell to provide balloon limiting rings can also be used with a device according to FIG. 2, in which case only the core thread S forming the yarn balloon is fed through the opening 35 or 36. They enable an increase in the number of revolutions and therefore improved production of the wrap-around device since in this embodiment the yarn balloon is carried around.

While a preferred embodiment of the invention has been described using specific terms, such description is for illustrative purposes only, and it is to be understood that changes and variations may be made without departing from the spirit or scope of the following claims.

What is claimed is:

1. Method for producing a wrap-around yarn of the type having an untwisted core thread of discontinuous textile fibers with a binder thread helically wound around the same, wherein the binder thread supplied by a bobbin and the core thread supplied by a pair of supply rollers are passed through a hollow spindle, the core thread is given a false twist and the wrap-around yarn is drawn from the hollow spindle and wound up, wherein the improvement comprises:

passing said core thread through a first opening into said hollow spindle;

separately passing said binder thread through a second opening in said hollow spindle while maintaining said bobbin stationary;

passing said binder thread through a section of the hollow spindle and to a core thread deflection point at which point the false twist is removed from said core thread; and wrapping said binder thread around said core thread in the area of said deflection point.

2. The method of claim 1 including the steps of:

passing said core thread and said binder thread through the hollow spindle in opposite directions; and discharging said core and binder thread from the hollow spindle through a third opening in said hollow spindle, whereupon said core thread and said binder thread are deflected at said deflection point whereas said binder thread is wrapped around said core thread.

3. The method of claim 1 including the steps of:

deflecting said core thread a first time and passing said thread through said first opening in said hollow spindle and introducing said core thread into the same;

deflecting said core thread a second time at said core thread deflection point and passing said core thread through said hollow spindle; and passing said binder thread straight through the hollow spindle and wrapping said binder thread around said core thread in the area of said deflection point.

4. Apparatus for producing a wrap-around yarn of the type which includes a pair of supply rollers for supplying a core thread, a pair of take-off rollers for winding up the wrap-around yarn, a driven hollow spindle arranged between said rollers, and a bobbin wound with a binder thread arranged coaxially on said hollow spindle, wherein the improvement comprises:

first and second openings provided adjacent respective ends of said hollow spindle;

a spindle disk means affixably carried by said hollow spindle;

an opening provided in a wall of said hollow spindle adjacent said spindle disk;

means for maintaining said bobbin stationary relative to said driven hollow spindle;

means for passing said core thread through one of said openings in said hollow spindle;

means for separately passing said binder thread through one of the other of said openings in said hollow spindle while maintaining said bobbin stationary relative to said driven hollow spindle; and means for wrapping said binder thread around said core thread in the area of said spindle disk and removing said core thread and said binder thread from said hollow spindle through said remaining opening.

5. The apparatus as set forth in claim 4, further comprising:

said one of said openings and said one of the other of said openings being said first and second openings, respectively; and said remaining opening being said opening in said wall of said hollow spindle.

6. The apparatus as set forth in claim 4 further comprising:

said one of said openings being said opening in said wall of said hollow spindle.

7. Apparatus for producing a wrap-around yarn of the type which includes a pair of supply rollers for supplying a core thread, a pair of take-off rollers for winding up the wrap-around yarn, a driven hollow spindle arranged between said rollers, and a bobbin wound with a binder thread arranged coaxially on said hollow spindle, wherein the improvement comprises:

first and second openings provided adjacent respective ends of said hollow spindle;

a spindle disk means affixably carried by said hollow spindle;

an opening provided in a wall of said hollow spindle adjacent said spindle disk;

means for maintaining said bobbin stationary relative to said driven hollow spindle;

means for feeding said core thread through said first opening into said rotating hollow spindle;

means for feeding said binder thread from said stationary bobbin through said second opening; and means for drawing said core thread and said binder thread from said hollow spindle through said opening in said wall and over said spindle disk means wrapping said binder thread around said core thread.

8. Apparatus for producing a wrap-around yarn of the type which includes a pair of supply rollers for supplying a core thread, a pair of take-off rollers for winding up the wrap-around yarn, a driven hollow spindle arranged between said rollers, and a bobbin wound with a binder thread arranged coaxially on said hollow spindle, wherein the improvement comprises:

first and second openings provided adjacent respective ends of said hollow spindle;

a spindle disk means affixably carried by said hollow spindle;

an opening provided in a wall of said hollow spindle adjacent said spindle disk;

means for maintaining said bobbin stationary relative to said driven hollow spindle;

means for feeding said core thread over said spindle disk means through said opening provided in said wall to the interior of said hollow spindle;

means for feeding said binder thread through said first opening into said hollow spindle;

means for drawing said core thread and said binder thread from said hollow spindle through said second opening wrapping said binder thread around said core thread.

9. The apparatus of claim 4 wherein said means for maintaining said bobbin stationary includes a magnetic field.

10. Apparatus of claim 4 wherein said spindle disk means includes a thread retainer for retaining said binder thread and/or said core thread.

11. Apparatus of claim 4 wherein said spindle disk means includes a balloon limiting means for limiting the ballooning of said threads.

* * * * *